US005197796A

United States Patent [19]

Moore

[11] Patent Number: 5,197,796

[45] Date of Patent: Mar. 30, 1993

[54] FLASHLIGHT AND EXTENSION THEREFORE

[76] Inventor: Larry Moore, c/o Adventurer's Outpost, P.O. Box 70, Cottonwood, Ariz. 86326

[21] Appl. No.: 907,857

[22] Filed: Jul. 2, 1992

[51] Int. Cl.[5] ..... F21L 7/00

[52] U.S. Cl. ..... 362/202; 362/157; 362/208

[58] Field of Search ..... 362/158, 202, 208, 157, 362/205

[56] References Cited

U.S. PATENT DOCUMENTS

| | | | |
|---|---|---|---|
| 3,710,092 | 1/1973 | Olbermann, Jr. | 362/208 X |
| 4,530,039 | 7/1985 | Shin-Shi | 362/202 X |
| 4,577,263 | 3/1986 | Maglica | 362/187 |
| 4,658,336 | 4/1987 | Maglica | 362/197 |
| 4,851,974 | 7/1989 | Maglica | 362/187 |
| 4,899,265 | 2/1990 | Maglica | 362/187 |
| 4,942,505 | 7/1990 | Maglica | 362/187 |

OTHER PUBLICATIONS

Mini-Maglite AA Flashlight Product Brochure, Published by Mag Instrument, Ontario, Calif.; Date of Publication Unknown. Packaged with Mini-Maglite AA Flashlights when sold.

*Primary Examiner*—Stephen F. Husar

[57] ABSTRACT

A conventional flashlight is modified to provide greater brightness by providing an extension tube between the base cap and the body of the flashlight. The extension holds one or more additional batteries so that a higher voltage and brighter bulb can be substituted for the original flashlight bulb. In a preferred embodiment, the extension has the same outer diameter as the body of the original flashlight so that it fits in the same mounts as the original flashlight. Where the flashlight body and extension have a thin sidewall surrounding the batteries so that there is insufficient thickness available to form threads in the sidewall of the portion of the extension that mates with the body and still leave room for a battery to pass through, then the battery in the extension is spaced away from that end and a cylindrical insulated bushing with an axial electrical conductor is provided therein to make electrical connection between the battery in the extension and the battery in the body. A longer and more powerful flashlight is obtained with no wasted parts, and which accepts a higher voltage, brighter light bulb.

20 Claims, 2 Drawing Sheets

FLASHLIGHT AND EXTENSION THEREFORE

FIELD OF THE INVENTION

This invention concerned an improved flashlight and method therefore.

BACKGROUND OF THE INVENTION

There are commercially available a large number of flashlights of many different configurations to suit different purposes. Flashlights are produced which use a wide range of battery sizes, as for example, AAA, AA, C, D, etc. Also, the materials of which flashlights are constructed vary widely. Some have metal bodies and glass or plastic lenses and plastic or metal reflectors, others have plastic bodies. The method of operating flashlights, that is, turning them on and off also varies greatly. Some flashlights for example, are operated by pressing, flipping, sliding or twisting an on-off switch mounted in the body of the flashlight and others are operated by rotating the head of the flashlight (where the light emerges) relative to the body. This rotation turns the flashlight on or off, and with some designs also varies the focus. In some flashlights, the batteries are inserted or removed by removing the head of the flashlight, in others by removing the base of the flashlight and with still others either or both may be removed and the batteries inserted or removed from either end.

The MAGLITE TM line of flashlights manufactured by Mag Instruments, Inc. of Ontario, Calif. are examples of metal bodied flashlights. They exist in a number of different configurations for different battery sizes and different numbers of batteries, e.g., 1 to 2 AAA or AA cells, 2 to 5 C cells, 2 to 6 D cells, etc. The versions manufactured by Mag Instruments, Inc. adapted to use AAA and AA size batteries are referred to as MINI MAGLITE TM flashlights. The MINI MAGLITE TM flashlights are turned on and off by rotating the head of the flashlight. Somewhat similar flashlights are also supplied by the Brinkman Corp. of Dallas, Tex. and by Streamlight, Inc. of Norristown, Pa. Flashlights of this type from these several different manufacturers often have in common that, (a) they use of one or two small batteries, e.g., AAA or AA cell batteries, (b) they are of substantially all metal construction (e.g. metal bodies, heads and bases), and (c) the on/off switching is accomplished by rotating the head of the flashlight relative to the body. Generally the base of the flashlight is removed for insertion and removal of the batteries and the head is removed for bulb replacement, but some work both ways. Small bi-pin, base-less, bulbs are also generally a common feature of these small AAA or AA cell, metal cased flashlights. Such flashlights are extremely popular because of their convenient size, ruggedness, durability and reasonable brightness. They are sold in very large quantities, probably exceeding a million a year. As used herein, the words "small metal case flashlight", singular or plural, are intended to refer generally to the MINI MAGLITE TM type of flashlight and its substantial equivalents, i.e., those having most or all of features (a)-(c) listed above. G. T. Price Products, Inc. of Los Angeles, Calif. is another maker of similar flashlights, but with a separate switch.

While many of these small metal case flashlights are used for general purposes, they are also particularly well suited for use in connection with firearms. For example, a number of mounts exist which allow versions of the small metal case flashlights to be mounted under or alongside a gun barrel so that when activated, they illuminate targets in the weapon boresight. The 1-2 AAA or AA cell versions are especially convenient in this application. While flashlights adapted to use larger battery sizes (e.g., C or D cells) are available, they are less convenient because of their greater weight and physical size because of the larger battery sizes. Thus, the AAA and AA cell small metal case flashlights are generally preferred, with the 2-cell versions being the most common.

When used in connection with weapons, illumination brightness and focus are especially important. While many of the available 1 to 2 AAA or AA cell small metal case flashlights provide adequate light beam focus, they do not provide sufficient light beam brightness. Thus, there is an ongoing need to obtain brighter light beams from such flashlights. Because of the very large number of such small metal case flashlights that already exist, it is desirable that the means for providing greater brightness be retrofitable to such existing small metal case flashlights so that there is no need to change the dimensions or arrangement of the weapon mounts that already exist and accommodate such existing small metal case flashlights, and so that persons who have already purchased such small metal case flashlights (and/or mounts therefore) may readily upgrade their flashlights to improve brightness without having to discard what they already have.

SUMMARY OF THE INVENTION

These and other deficiencies of the prior art are overcome by providing an extension that attaches to an existing conventional flashlight thereby permitting increased capacity and allowing a higher voltage and brighter bulb to be employed. The combination provides a new flashlight of increased capacity and brightness that still fits in mounts sized for the original flashlight.

The extension comprises most generally, a substantially cylindrical barrel for holding at least one additional battery, wherein the barrel has a first attachment means of a first type at a first end which mates with the base end of the original flashlight and a second attachment means of an opposite type at an opposed second end of the barrel for receiving the original base cap of the flashlight. In a preferred embodiment, the outer diameter of the extension barrel and the body of the flashlight body are substantially the same and the attachment means are threaded.

Where the sidewall of the flashlight body and the extension are such that they can, for example, screw together while still having an interior through-bore in the extension which allows free passage of the extra battery therein, then the inward facing pole of the battery in the extension can slide into the flashlight body until it contacts the opposite pole of the battery in the flashlight body. The base of the flashlight closes off the outboard end of the extension and makes electrical contact to the outboard pole of the battery in the extension in the same manner it did in the original flashlight.

Where the sidewall of the flashlight body and extension are thinner so that they cannot be attached and still leave a battery sized through-bore in the extension, then the battery in the extension is desirably spaced back from the end which mates with the flashlight body and an electrical connection block is inserted therein for providing electrical connection between the battery in the extension and the battery in the flashlight body so that the batteries are electrically in series. In a preferred embodiment, the electrical connection block comprises a cylindrical insulator with a portion having a first diameter smaller than the extension battery and located interior to the extension. An electrical contact on the end inside the extension makes contact with the battery therein and another contact outside the extension, preferably a spring, makes contact with the opposite pole of the battery in the flashligh body. An electrical lead extending axially through the connection block couples the two contacts.

It is an advantage of the present invention to provide a flashlight with improved light beam brightness by retrofitting an existing small metal case flashlight to have greater battery capacity so that a brighter bulb may be used, without requiring any change in the outer diameter of the body of the flashlight. In a preferred embodiment this is accomplished without discarding any part of the existing flashlight (except the old bulb).

DETAILED DESCRIPTION OF THE FIGURES

Figure 1A:
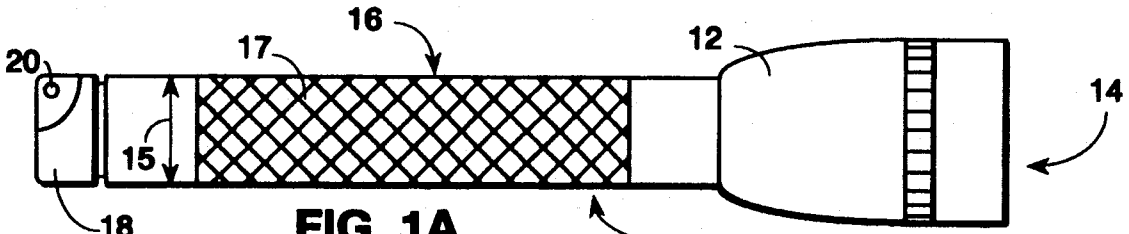
FIG. 1A PRIOR ART
FIGS. 1A and 1B are, respectively, simplified side and base end (left end) views of a conventional flashlight according to the prior art.
Figure 1B:
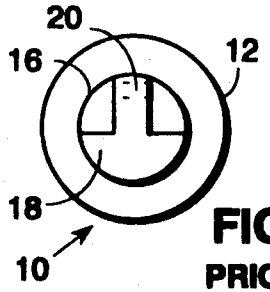
FIG. 1B PRIOR ART

FIGS. 1A and 1B are, respectively, simplified side and base end (left end) views of conventional flashlight 10 according to the prior art. Flashlight 10 comprises head 12 with lens 14 from which the flashlight beam emerges, body 16 with outer diameter 15 and optional knurling 17 and base cap 18. Base cap 18 typically has small hole 20 by which flashlight 10 can be suspended from a strap or cord to prevent loss. Body 16 is typically an elongated cylinder.

Figure 2:
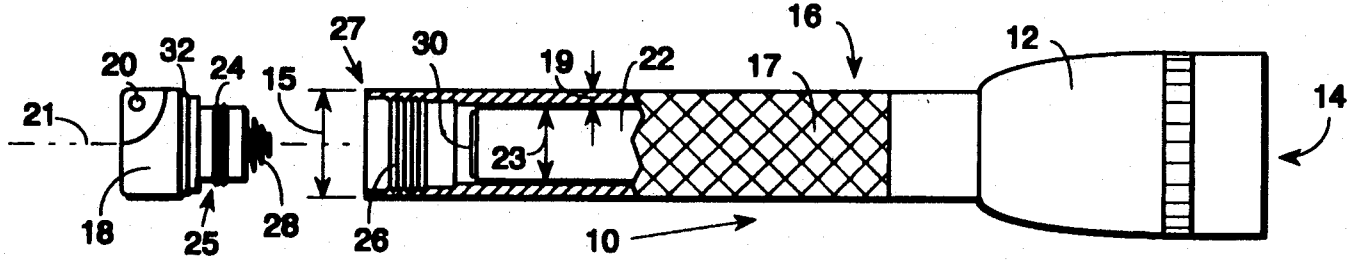
FIG. 2 PRIOR ART
FIG. 2 shows a partially cut-away and cross-sectional exploded side view of the flashlight of FIGS. 1A–B with the base cap removed.

FIG. 2 shows a view of flashlight 10 similar to that of FIG. 1A but with base cap 18 removed along centerline 21 and with body 16 partially cut-away and cross-sectioned so that body wall thickness 19 and battery 22 of outer diameter 23 are visible inside flashlight 10. Base cap 18 has threads 24 on base cap portion 25 which are adapted to engage threads 26 in base end 27 of body 16. While threads 24, 26 and others shown in subsequent figures are depicted for providing attachment means, this is for purposes of illustration and explanation and is intended to be exemplary and not limiting.

Generally, base cap 18 has spring contact 28 attached to portion 25 which is adapted to provide a pressure contact to electrode 30 of battery 22 when base cap 18 is installed in body 16. Some flashlights 10 include "O" ring 32 on base cap 18 to increase the water resistance of flashlight 10 when base cap 18 is installed in flashlight body 16.

Figure 3:
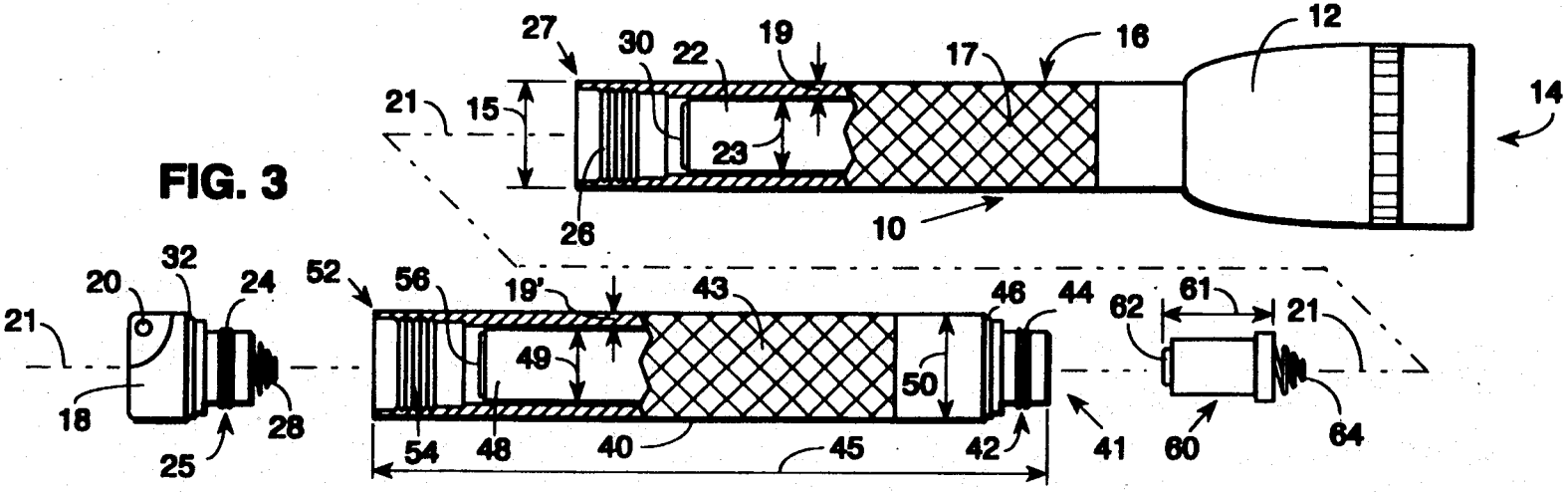
FIG. 3 shows a partially cut-away and cross-sectional exploded side view of the flashlight of FIGS. 2 combined with a flashlight extension according to a first embodiment of the present invention.

FIG. 3 shows a partially cut-away and cross-sectional exploded side view of flashlight 10 of FIGS. 2 combined with flashlight extension 40 with optional knurling 43 similar to knurling 17, according to a first embodiment of the present invention. Flashlight extension 40 fits between flashlight body 16 and base cap 18.

First end 41 of extension 40 has portion 42 which has features in common with portion 25 of base cap 18. For example, portion 42 of extension 40 has threads or other attachment means 44 and optional "O" ring 46 similar to threads or other attachment means 24 and optional "O" ring 32 on portion 25 of base cap 18, and generally has other shape and dimensions so that portion 42 mates with threads or other attachment means 26 and other features of end 27 of flashlight body 16, in substantially the same manner as portion 25 of base cap 18. Thus, when base cap 18 is removed from barrel 16, extension 40 can be attached in its place. Extension 40 contains an additional battery (or batteries) 48 of outer diameter 49. In a preferred embodiment, extension 40 has the shape of a hollow barrel or cylinder. It is desirable that extension 40 have outer diameter 50 that is substantially the same as outer diameter 15 of flashlight body 16, but this is not essential. When the two are the same diameter, then extension 40 fits into the mounts adapted to grasp flashlight 10 around body 16. This is especially convenient in firearm applications.

Base end 52 of extension 40 has threads or other attachment means 54 and other shape and dimensions similar to those found at base end 27 of flashlight body 16 so that cap 18 may be attached to base end 52 of extension 40 in substantially the same manner that base cap 18 attached to body 16. When base cap 18 is joined to extension 40, spring 28 of base cap 18 makes electrical contact with terminal 56 of battery 48 to provide electrical continuity to battery 48 in extension 40 in much the same manner as it provided electrical continuity to battery 22 in flashlight body 16. That is, portion 25 of base cap 18 engages end 52 of extension 40 in the same manner that it engaged end 27 of flashlight body 16.

Depending upon wall thicknesses 19, 19' and outer diameters 15, 50 as compared with outer diameters 23, 49 of batteries 22, 48 (as will be more fully explained in connection with FIG. 4) electrical connection means 60 of length 61 may be required to provide electrical continuity between additional battery 48 in extension 40 and original battery 22 in flashlight 10. Connection means 60 has first contact 62 for making electrical connection to battery 48 and second contact 64 for making electrical connection with contact or pole 30 of battery 22. Connection means 60 is shown in greater detail in FIGS. 5–6.

Figures 4, 5, 6, 7:
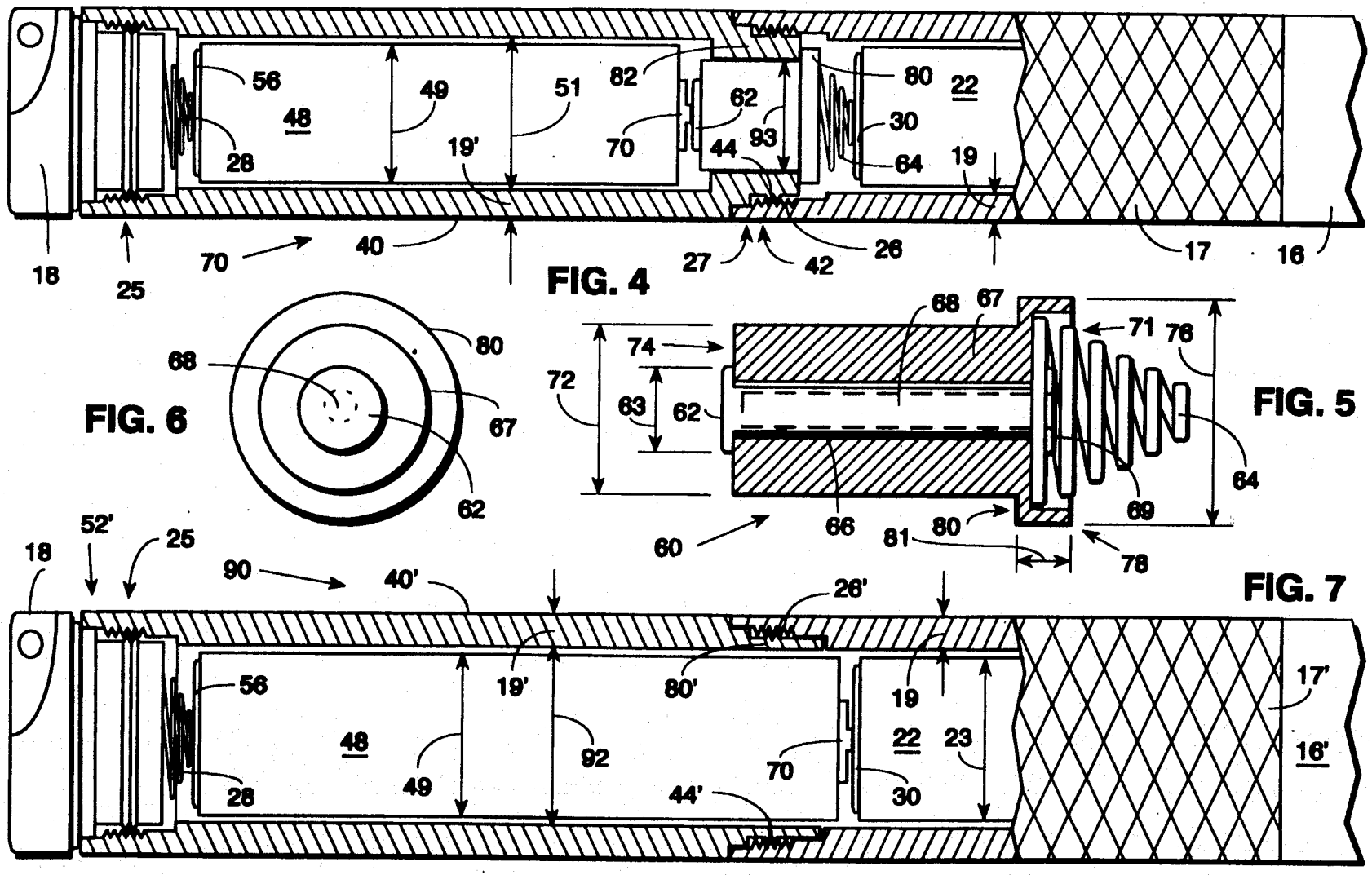
FIG. 4 shows a partially cut-away and cross-sectional assembled side view of a portion of the flashlight of FIG. 3, according to the first embodiment of the present invention.
FIG. 5 shows a partially cut-away and cross-sectional side view of a component of the flashlight of FIG. 4, according to the first embodiment of the present invention.
FIG. 6 is a left end view of the component of FIG. 5.
FIG. 7 is a view similar to that of FIG. 4 but according to another embodiment of the present invention.

FIG. 4 shows a partially cut-away and cross-sectional side view of portion 70 of the flashlight of FIG. 3 when assembled, according to the first embodiment of the present invention. Extension 40 containing battery 48 and electrical connection means 60 is attached to body 16 such that contact 64 makes connection to pole 30 of battery 22 in flashlight body 16. Extension 40 is held in place in body 16 by means of engaged threads or other attachment means 26, 44. "O" ring 46 has been omitted from FIG. 4 for clarity.

Electrical contact 62 having diameter 63 on connection means 60 makes electrical connection with pole 70 of battery 48. Electrical connection 66 (see FIGS. 5–6) extends through insulating bushing 67 of connection means 60 from contact 62 to contact 64. Contact 62 is conveniently formed from the head of an attachment means (e.g., a rivet, screw, etc.) whose shank 68 provides connection 66 through bushing 67 to contact 64. Shank 68 is preferably hollow. Contact 64, preferably a spring, is conveniently held in place by retainer means 69 at the end of shank 68. Any suitable means may be used for retainer 69, but it is convenient to provide retainer means 69 by deforming the end of shank 68 so as to press a portion of the bottom coil of spring contact 64 against face 71 of insulated bushing 67. This is conveniently accomplished using means well known in the art where contact 62 and shank 66 are parts of a conventional rivet.

Insulated bushing 67 conveniently has outer diameter 72 at first end 74 and larger outer diameter 76 at second end 78, thus providing shoulder 80 of height 81. As is shown in FIG. 4, outer diameter 72 is chosen so as to pass within the interior of portion 42 of extension 40 so that contact 62 is brought into proximity with pole 70 of battery 48. In the embodiment of FIGS. 3–4, battery 48 is recessed from end 41 of extension 40 to make room for connection means 60. Shoulder 80 controls the penetration of connection means 60 into extension 40, although other means well known in the art of controlling the relative location of connection means 60 and extension 40 may also be used.

The arrangement of FIG. 4 using electrical connection means 60 is used where wall thicknesses 19, 19' are such that too little material would be left in location 80 (see FIG. 4) interior to threads or other attachment means 44 if the entire length of extension 40 had internal diameter 51 to accommodate external diameter 49 of battery 48. When wall thicknesses 19, 19' are small and threads or other attachment means 26 at end 27 of body 16 are internal, then additional material must be left in location 80 to permit threads or other attachment means 44 to be formed. In this situation, outer diameter 72 of bushing 67 is generally less than outer diameter 49 of battery 48, and extension 40 is made slightly longer than would otherwise be necessary in order to accommodate connection means 60.

FIG. 7 illustrates another embodiment of the present invention in which flashlight portion 90 similar to portion 70 of FIG. 4 is shown, but wherein wall thicknesses 19, 19' of body 16' and extension 40' are such that extension 40' can have a straight-through interior bore diameter 92 (at least at end 41) which accommodates outer diameter 49 of battery 48. In this situation, electrical connection means 60 is not needed and sufficient metal thickness exists in region 80' to permit threads or other attachment means 44' to be formed to engage threads or other attachment means 26' of body 16'.

When connection means 60 is not needed, then pole 70 of battery 48 can directly contact pole 30 of battery 22. Alternatively, poles 70 and 30 can be coupled by a connective plug (not shown) similar to connection means 60 but without shoulder 80 and desirably with an outer diameter comparable to battery diameter 49, 23. With this arrangement, a spring is not needed for contact 64, since battery 48 (and the optional uniform diameter connective plug) are free to move longitudinally (i.e., axially) in response to spring 28 of base cap 18, so as to insure good electrical contact between all of the elements of the flashlight.

EXAMPLE

Extension 40 is desirably manufactured from the same materials used for body 16 of flashlight 10, as for example aluminum. It is desirable that the aluminum be anodized to match the color of flashlight 10. The threaded regions should be bare of anodization oxide to as to promote good electrical connection between the extension and the body and the cap and the extension. The desired regions can be kept substantially free of oxide by masking prior to anodization or removed after anodization by machining. Outer diameter 50 is desirably the same as outer diameter 15 of body 16 and inner diameter 51, 92 of extension 40, 40' is of a size to allow the desired size batteries (e.g., AAA or AA) to easily slip in and out, similar to the interior diameter provided in flashlight body 10. Spring 64 is desirably stainless steel.

Connection means 60 desirably comprises bushing 67 of a machineable or moldable plastic. Machineable Nylon ™, as for example Delrin ™ brand Nylon supplied by Dupont, Inc. is suitable. A copper coated hollow rivet conventiently provides contact 62 and shank 66 and its formed end acts as retention means 69. The threads and other dimension of extension 40 are compatible with the flashlight to which extension 40 is intended to mate. For example, diameter 15 of a 2-AA cell MINI MAGLITE is about 0.72 inches and dimension 50 is desirably similar. Wall thicknesses 19, 19' for this flashlight are about 0.078 inches.

Length 45 of extension 40 is chosen depending upon how many batteries are intended to be accommodated in extension 40. For example, length 45 of about 2.9 inches is suitable for a single AA cell 48. Connection means 60 has a length 61 of about 0.5 inches including the thickness of contact 62, plus a spring height of about 0.3 inches. Shoulder height 81 is conventiently about 0.1 inches. Outer diameter 72 of connector 60 is conventiently about 0.5 inches and interior diameter 93 of region 42 of extension 40 is a few mils larger to allow connector 60 to slip easily into extension 40. Outer diameter 76 of connector 60 is about 0.56 inches. Shoulder 80 conveniently controls the penetration of connector 60 into extension 40. Larger or smaller dimensions can be used depending upon the particular dimensions of the flashlight to which extension 40 is intended to mate. For each additional battery cell desired to be contained within extension 40, length 45 is increased by about the cell length.

Ordinarily, 3 volt bi-pin lamps are used with the standard 2-AA cell small metal case flashlights. When extension 40 is in place with an additional AA battery, a 4.5 volt bi-pin lamp is substituted. This is the only portion of existing, standard, small metal case flashlight 10 that is discarded. Everything else is re-used. Type T1, bi-pin, 4.5 volt lamps suitable for use with the improved extended flashlight of the present invention are available from the Carly Lamp Company, Torrence, Calif. Either vacuum or gas filled varieties may be used. Light intensity measurements comparing a 2-AA cell MINI MAGLITE using a standard 3 volt bulb and the same flashlight with a 1-AA cell extension according to the present invention and using a 4.5 volt vacuum bulb showed a 50–100% brightness increase, and using a 4.5 volt Xenon bulb showed a 250% or greater brightness increase. There is not significant loss of focus which arises from using the higher voltage, brighter bulbs.

However, when it is desired to use the Xenon type bulb, it is preferably to use a metal rather than plastic reflector since the bulb temperature is higher than with vacuum type bulbs. The improvements in illumination intensity obtained with the present invention are very significant, especially in connection with flashlights intended for firearms applications.

Having thus described the invention, it will be apparent to those of skill in the art that the present invention provides a significant increase in battery capacity and permits the use of higher voltage lamp bulbs capable of providing greater brightness, and that substantially higher beam brightness is obtain without any degradation of focus characteristics. Further, this is accomplished in a manner that is fully retrofitable onto existing commercially available flashlights. In addition, the resulting improved, higher intensity flashlight can have the same outer diameter as the original standard flashlight, even with small metal case flashlights, so that it can fit in the same mounts as the original standard flashlight to which it adapts. In addition, no parts of the flashlight being upgraded (except the lamp bulb) need be discarded. This permits millions of existing owners of such flashlights to upgrade their existing flashlights, rather than being forced to replace them, which is a significant benefit.

While the present invention has been described for convenience by way of certain illustrative embodiments, these are not intended to be limiting. For example, extension 40 is shown as having a male thread on the end which attaches to body 16 and a female thread on the end which receives base cap 18, which accommodates the customary manner of construction of existing small metal case flashlights. However, this is not essential and the present invention is also useful with flashlights that have male threads on their base ends and female threads on their base caps. In this situation, the male and female threads on extension 40 are interchanged. The same consideration applies as to whether electrical connection block 60 is needed, that is, is the sidewall thickness sufficient to accommodate the threads or other attachment means in the desired region and still leave a clear through-bore for a battery at least through the flashlight end of the extension. If not, then a narrower region is needed in the extension in the vicinity of the or other attachment means (e.g., the male threaded portion) and a connection block analogous to connection 60 is used. Those of skill in the art will understand based on the description herein how to modify the illustrated design to adapt it to the situation where the sex of the attachment means on the flashlight body and base cap are interchanged. Accordingly, it is intended to include these and such other modification and variations as will occur to those of skill in the art based on the teachings herein, in the claims that follow.

I claim:

1. An extender for use with a flashlight housing which has one or more batteries and a base end with a removable base cap, comprising:

a substantially cylindrical barrel for holding at least one battery, wherein the barrel has a first attachment means of a first type at a first end which mates with the base end of the flashlight housing and a second attachment means of an opposite type at an opposed second end of the barrel for receiving the base cap of the flashlight housing; and an electrical connection block fitted to the first end of the barrel for providing electrical connection between a first pole of a first battery mounted in the barrel and a first pole of a second battery mounted in the flashlight housing so that the first and second batteries are electrically in series.

2. The extender of claim 1 wherein the electrical connection block comprises a cylindrical insulator with opposed first and second ends and having in a first region, a first outer diameter adapted to fit within a mating cylindrical opening of a first inner diameter located in the first end of the barrel, and wherein the electrical connection block has in a second region a second outer diameter larger than the first outer diameter.

3. The extender of claim 2 wherein the electrical connection block further comprises a first electrically conductive contact at the first end and a second electrically conductive contact at the second end and an electrical connection therebetween.

4. The extender of claim 3 wherein the first electrically conductive contact has a diameter greater than its thickness and the second electrically conductive contact comprises an electrically conductive spring.

5. The extender of claim 4 wherein there is provided in the second end a recess for receiving a first end of the electrically conductive spring.

6. The extender of claim 5 wherein the electrically conductive spring has a conical shape with the first end of the spring being larger in diameter than an opposed second end of the spring.

7. The extender of claim 1 wherein the barrel is electrically conducting and the base cap of the flashlight housing, when mounted to the barrel, provides electrical continuity between a second pole of the first battery and the barrel.

8. The extender of claim 7 wherein the barrel provides electrical contact between the second pole of the first battery and the flashlight housing.

9. The extender of claim 1 wherein the barrel comprises no electrical on/off switch.

10. The extender of claim 1 wherein the attachment means of the threaded base end of the flashlight housing is a female thread and the first attachment means is a male thread mating with such female thread.

11. The extender of claim 1 wherein the base cap end of the flashlight housing has a male thread and the second attachment is a female thread for accepting such male thread.

12. An accessory for increasing the light intensity provided by a flashlight, wherein the flashlight has a metal housing for containing one or more flashlight batteries and a removable cap at a base end of the metal housing, the accessory comprising:

an extension barrel for containing one or more additional batteries, wherein a first end of the extension barrel mates with the base end of the metal housing, and a second end of the extension barrel mates with the base cap which provides electrical continuity between a pole of the one or more additional batteries within the extension barrel and the housing; and electrical connection means mounted in the first end of the barrel and having at a first end thereof, a first electrical connection interior to the barrel for making electrical contact with a another end of one or another to the first additional batteries and, at a second opposed end thereof, a second electrical connection exterior to the barrel for making electrical contact with a first end of one of the flashlight batteries.

13. The accessory of claim 12 wherein the electrical connection means comprises an insulating bushing having therethrough an electrical connection leading between the first and second electrical connections.

14. The accessory of claim 12 wherein the electrical connection means comprises an insulating bushing and passing therethrough from a first to a second end thereof, a metallic fastener having a head forming the first electrical connection adjacent the first end of the bushing and a retaining means opposite the head for holding in place against the second end of the bushing an electrically conductive spring forming the second electrical connection.

15. A flashlight comprising:

a head region for containing a light source;

a first body region for containing one or more batteries electrically coupled to the light source;

a second body region separably joined to the first body region at a first end thereof for containing one or more additional batteries; and electrical connection means comprising an insulator having therewith an electrical conductor extending between the one or more batteries and the one or more additional batteries for providing electrical continuity therebetween.

16. A flashlight comprising:

a head region for containing a light source;

a first body region for containing one or more batteries electrically coupled to the light source;

a second body region separably joined to the first body region at a first end thereof for containing one or more additional batteries; and electrical connection means between the one or more batteries and the one or more additional batteries for providing electrical continuity therebetween, wherein the electrical connection means comprises a substantially cylindrical insulator having a central electrical connection therethrough, wherein the central electrical connection extends from a first electrical contact substantially centrally located on a first end of the insulator for making contact with a pole of a battery in the second body region and to a second electrical contact substantially centrally located on a second end of the insulator for making contact with a pole of a battery in the first body region.

17. The flashlight of claim 16 wherein one of the first or second electrical contacts comprises a spring.

18. The flashlight of claim 16 wherein the insulator has a first region of a first diameter and a second region of different diameter.

19. A flashlight comprising:

a head region for containing a light source;

a first body region for receiving the head region at a first end of the body region and containing one or more batteries having a first pole proximate the first end of the first body region and a second pole proximate a second opposed end of the first body region;

a second body region having a first end separably joined to the second end of the first body region, for containing one or more additional batteries, said one or more additional batteries having a third pole electrically coupled to the second pole and having a fourth pole proximate a second end of the second body region;

a base cap at the second end of the second body region for providing contact to the fourth pole; and an insulator with an electrical conductor coupled thereto, located between the second and third poles, wherein the electrical conductor makes contact to the second and third poles for providing said electrical coupling therebetween.

20. The flashlight of claim 19 further wherein the electrical conductor extends substantially along an axis of the insulator.

* * * * *